United States Patent [19]

Horton

[11] 4,311,108

[45] Jan. 19, 1982

[54] PROPELLED WATER CRAFT

[76] Inventor: Jerry L. Horton, 2925 Eugene St., Bossier City, La. 71112

[21] Appl. No.: 12,875

[22] Filed: Feb. 16, 1979

[51] Int. Cl.[3] ..... B63B 1/00

[52] U.S. Cl. ..... 114/61; 114/144 RE; 9/7; 440/6

[58] Field of Search ..... 114/61, 144 R, 144 RE, 114/144 A, 151; 115/12 R, 12 A, 35, 37, 38, 17, 18 R, 18 E, 18 A; 9/1.6, 1.7, 7, 5; 440/7, 87

[56] References Cited

U.S. PATENT DOCUMENTS

| | | | |
|---|---|---|---|
| 1,667,475 | 4/1928 | Kasley | 115/38 |
| 1,819,570 | 8/1931 | Parker | 9/5 |
| 3,193,228 | 7/1965 | Chion | 9/1.7 |
| 3,236,202 | 2/1966 | Quady | 114/61 |
| 3,665,885 | 5/1972 | Javes | 114/61 |
| 3,889,625 | 6/1975 | Roller | 114/18 E |
| 3,995,579 | 12/1976 | Childre | 115/18 E |
| 4,048,685 | 9/1977 | Gail | 114/61 |
| 4,143,436 | 3/1979 | Jones | 115/18 E |

*Primary Examiner*—Trygve M. Blix
*Assistant Examiner*—D. W. Keen
*Attorney, Agent, or Firm*—John M. Harrison

[57] ABSTRACT

A propelled water craft which is generally characterized by a twin pontoon barge having a generally flat deck, a seat pedestal mounted on the deck and carrying a rotatable, folding seat, and further characterized by port and starboard variable speed, reversible motors mounted in the rear of the water craft behind each one of the pontoons and operative responsive to on-off pressure switches, forward and reverse thrust switches, and speed controls.

13 Claims, 10 Drawing Figures

PROPELLED WATER CRAFT

BACKGROUND OF THE INVENTION

1. Field of the Invention

This invention relates to a water craft having external propulsion means, and more particularly, to a light, highly maneuverable water craft characterized by a spaced pair of pontoons capped by an essentially flat deck to form the hull, with a pair of battery powered electric motors positioned at the rear of the pontoons to supply propulsion. In a preferred embodiment of the invention the water craft is propelled by a pair of stationary, reversible electric motors which are designed to operate responsive to separate motor activation controls and speed and thrust controls, with the direction and speed of the water craft determined by selective activation and forward and reverse operation of the motors, and by variable speed controls. A significant feature of the water craft of this invention is positive control in any direction without the use of steering cables, rods, wheels and other conventional means of manipulating the attitude of the drive motor or motors to achieve directional control of the water craft.

2. Description of the Prior Art

Perhaps one of the fastest growing industries in the United States today is the production of sports water craft for sailing, general purpose boating and fishing. Water craft of all shapes and sizes, ranging from 50 to 75 feet in length and larger, to small sailboats, pirogues and prams in the 6 to 15 foot length catagory are becoming increasingly popular as boating and sport fishing become more prevalent with each passing year. With the rapid increase in the sport of fresh water fishing, and bass fishing in particular, has come a virtual explosion in the production of fishing boats and rigs of all shapes, sizes and designs, most of which are supplied with outboard or inboard-outboard motors and auxiliary electric trolling motors. Generally, the gasoline powered outboard or inboard-outboard motor is used to speed the boat to the fishing area, while the electric trolling motor is then utilized to silently position the boat near desirable fishing areas with a minimum of noise and effort. Many of these fishing boats have become highly sophisticated in design and performance, at an accompanying high cost. For example, the average bass fishing rig used all over the United States in recent years might typically be about 17 feet in length and 5 or 6 feet in width, and is fitted with a 100 or 150 horsepower outboard or inboard-outboard motor, and an electric trolling motor. The cost of such a boat may range from about $4,000 to about $6,500 or more.

A primary disadvantage of large, heavy boats such as the one described above, and particularly the boats used in fresh water lakes which are characterized by stumps and logs, is the problem of the boat and outboard motor becoming lodged on a stump or log while moving through the water under the power of an electric trolling motor. When this occurs, weight must be shifted in the boat, or the outboard or inboard-outboard engine must be started to remove the boat from the obstacle, thus disturbing the fishing area. Another disadvantage of water craft and boats characterized by a high performance outboard or inboard-outboard engine is the increasing cost of operation, which rises with increasing horsepower and the rapidly escalating cost of gasoline and other petroleum products. Still another problem inherent in such water craft is the ever increasing problem of water pollution created by gasoline and oil, and by the products of combustion produced by such engines, particularly under circumstances where many such boats are located on waterways of limited size.

Accordingly, it is an object of this invention to provide a new and improved propelled water craft of pontoon design which is stable, light in weight, easily maneuvered around obstacles and removed from obstacles when lodged thereon, and does not pollute the water.

Another object of this invention is to provide a new and improved water craft which is characterized by a hull which includes a pair of pontoons and a generally flat deck with a seat pedestal carrying a folding and rotating seat mounted thereon, which craft is propelled by twin, stationary-mounted, reversible motors positioned at the rear of the pontoons and at a selected horizontal angle with respect to the longitudinal axis of the pontoons, and is controlled by selectively activating the motors and by varying the thrust intensity and direction of the motors.

Yet another object of the invention is to provide a new and improved, safe pontoon-floated water craft which is propelled by a pair of built-in, reversible, multiple speed electric motors which are stationary-mounted in a selected horizontal, angular relationship with respect to the longitudinal axis of the pontoons, respectively, and with directional control of the water craft achieved by foot operated selective activation of the motors, by speed control adjustment, and by controlling alternate forward and reverse thrust of the motors.

Another object of this invention is to provide a new and improved battery powered, electric motor-propelled water craft which is characterized by a pair of reversible, variable speed, battery operated electric motors fixedly mounted at the rear of a pontoon hull, which motors may be controlled as to activation and deactivation, direction of thrust, and speed.

A still further object of this invention is to provide a new and safe battery-powered water craft which is characterized by a twin-pontoon hull having a generally flat deck and one or more elevated, folding and rotating seats, and further characterized by a pair of built-in, reversible, variable speed, direct current-operated electric motors having multivoltage capability, which motors are mounted to stationary, side-by-side arrangement at the rear base of the pontoons with the front end of each of the motors skewed or slanted in a selected outward, horizontal angular relationship to the longitudinal axis of the pontoons, respectively, and are capable of providing selective forward and reverse thrust at variable speed responsive to conveniently located feet and hand controls.

SUMMARY OF THE INVENTION

These and other objects of the invention are provided in a propelled water craft which is characterized by a twin-pontoon hull having a generally flat deck with at least one seat pedestal and elevated seat mounted thereon, the water craft being propelled by a pair of built-in, battery operated electric motors mounted at the rear base of the pontoons and designed for forward and reverse operation at varying speeds, with the direction of the water craft being controlled and determined by foot manipulated motor activation switches, and by varying the speed of each motor, and effecting forward and reverse thrust of the motors at selected speed settings through manipulation of hand controls.

BRIEF DESCRIPTION OF THE DRAWINGS

The invention will be better understood by reference to the accompanying drawing, wherein.

DESCRIPTION OF THE PREFERRED EMBODIMENTS

Figure 1:
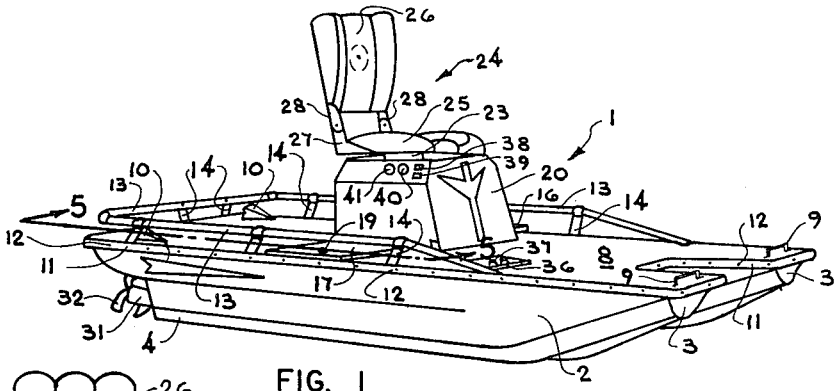
FIG. 1 is a side perspective view of a preferred embodiment of the propelled water craft of this invention.
Figure 2:
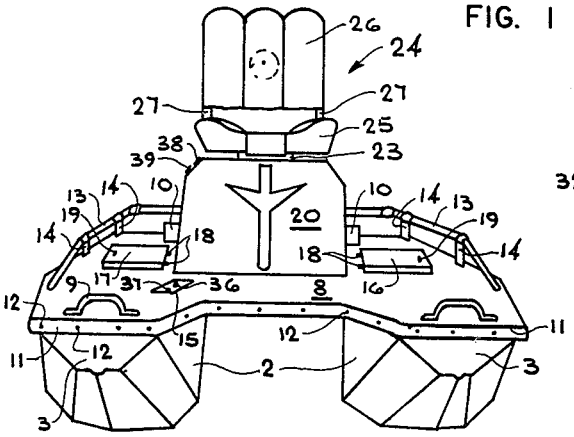
FIG. 2 is a front perspective view of the propelled water craft illustrated in FIG. 1.
Figure 5:
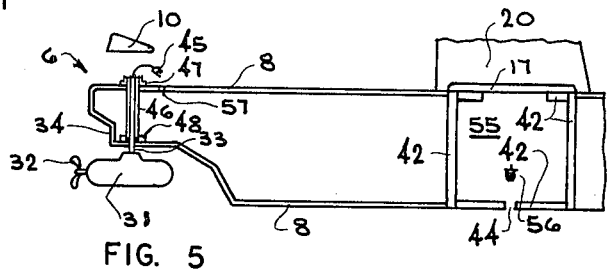
FIG. 5 is a sectional view, taken along lines 5—5 of FIG. 1, of the starboard pontoon of the water craft of this invention illustrating a preferred mounting of, and access to, starboard motor 31, and further illustrating a preferred configuration of the optional live well.
Figure 3:
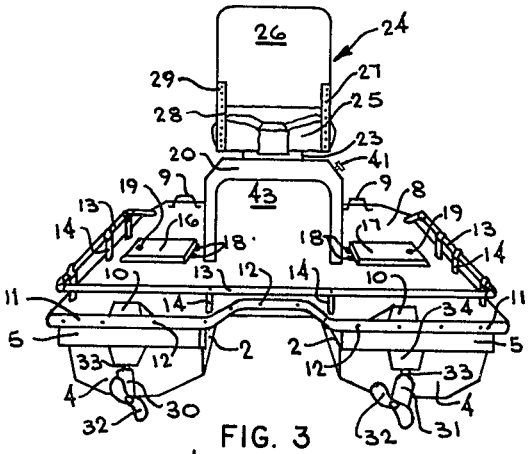
FIG. 3 is a rear perspective view of the propelled water craft illustrated in FIGS. 1 and 2.

Referring now to FIGS. 1-3, 5 and 6 of the drawing, the propelled water craft of this invention is generally illustrated by reference numeral 1, and includes a hull formed by pontoons 2, which are positioned in spaced, generally parallel fashion. Pontoons 2 are shaped with an upward sweeping frontal portion terminating in a pontoon front 3, as illustrated in FIG. 2, and are further characterized by a pontoon step 4, and a pontoon back 5, as illustrated in FIG. 3 of the drawing. Pontoons 2 are spaced and capped by a generally flat deck 8, as illustrated. Deck 8 is further provided with a pair of handles 9 to facilitate securing the craft to a dock or other fixed object on the bank during use, and lifting and moving propelled water craft 1 when the craft is not in the water. Deck 8 is also provided with a pair of access caps 10 which cover motor shaft retainer assembly 6, positioned above the motors and in the rear of the pontoons, as illustrated in FIG. 5. A deck trim 11 is provided around the periphery of deck 8 to cap the juncture of deck 8 and pontoons 2. In a preferred embodiment of the invention a waterproof sealing material such as a silicone base seal is provided beneath deck trim 11 prior to the application of trim fasteners 12 to secure the deck trim 11 to pontoons 2 in waterproof fashion. Deck 8 is also provided with a deck rail 13, fastened to deck 8 by means of rail supports 14, and extending rearwardly from the forward segment of each one of pontoons 2 continuously around the back of propelled water craft 1, as illustrated.

Referring specifically to FIGS. 3 and 5, in another preferred embodiment of the invention deck 8 is further provided with an ice chest and a live well, both of which may be lined with an expanded foam insulation 42, and which are preferably positioned on each side of seat pedestal 20, and covered by an ice chest lid 16, and a live well lid 17, respectively. In a preferred embodiment the cross sectional segments of insulation 42 are reinforced with fiberglass mat or wood, and are sealed to provide three watertight compartments in each one of pontoons 2, as illustrated in FIG. 5. This embodiment provides an additional safety feature in the event of puncture of the pontoons. Ice chest lid 16 and live well lid 17 may be similarly insulated, and are hinged to deck 8 by lid hinges 18, as illustrated in FIGS. 2 and 3, and are also each fitted with a lid pull 19 to facilitate easy access into the interior of the ice chest and live well. Both the ice chest and live well are preferably characterized by interior compartments 55, provided in deck 8 and pontoons 2, as illustrated in FIG. 5. In addition, the live well is preferably provided with a live well drain 44, which can be utilized to allow water to enter the live well by removing drain plug 56.

Figure 4:
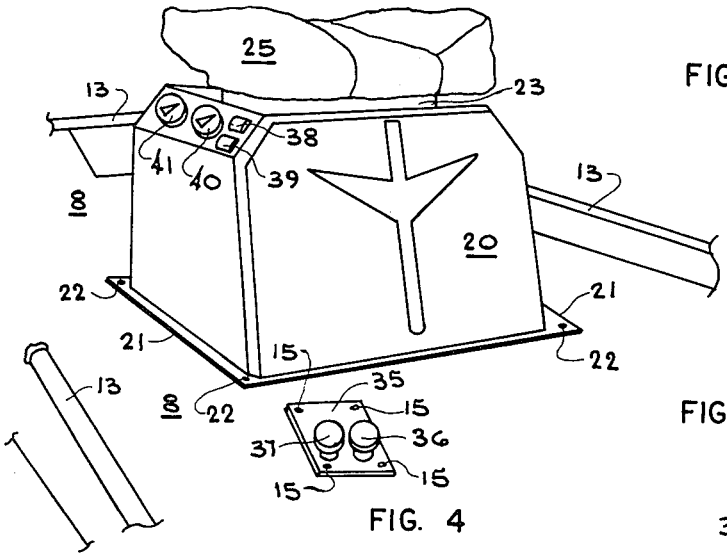
FIG. 4 is a front perspective view, partially in section, of the pedestal and deck area of the propelled water craft illustrated in FIGS. 1-3, more particularly illustrating a preferred control arrangement.
Figure 7:
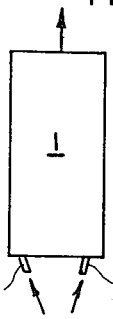
FIG. 7 is a block diagram illustrating directional movement of the water craft when both motors are thrusting in the forward direction.
Figure 8:
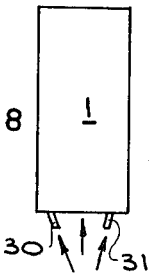
FIG. 8 is a block diagram illustrating directional movement of the water craft when both engines are thrusting in the reverse direction.

Referring now to FIGS. 2-4, seat pedestal 20 is positioned generally in the center of deck 8 and serves not only to support seat 24, but also to provide a housing or cover for at least one, and as many as four batteries in battery storage area 43, located beneath seat pedestal 20, as illustrated in FIG. 3 of the drawing. In a further preferred embodiment of the invention seat 24 is characterized by a generally horizontally disposed seat cushion 25, which is mounted in conventional fashion on a seat swivel 23 to permit 360° rotation of seat 24 on seat pedestal 20. Seat 24 is further provided with a back support 26, which is attached to seat cushion 25 by means of a seat bracket 27 and bracket fasteners 29. Seat bracket 27 is fitted with a bracket hinge 28 which facilitates optional folding of back support 26 downwardly against seat cushion 25 when seat 24 is not in use.

Referring now to FIGS. 1, 3, 5 and 6 of the drawing, in a preferred embodiment of the invention the propulsion system for the propelled water craft 1 is characterized by a battery powered electric port motor 30 and starboard motor 31, each carrying a propeller 32 and extending downwardly from shaft support 34 by means of a motor shaft 33. Port motor 30 and starboard motor 31 are mounted on motor shaft 33 in horizontal angular relationship with respect to the longitudinal axis of pontoons 2, as illustrated in FIG. 3. This angular relationship between the motors and the respective pontoons to which they are attached has proved to be an important factor in achieving a high degree of maneuverability of propelled water craft 1, as hereinafter described. The front ends of the motors may be angled or skewed to the outside or inside of the longitudinal axis of the pontoons, as viewed in FIG. 3; however, in a preferred embodiment of the invention, the front ends of the motors are angled to the outside, since this motor position has been found to achieve maximum maneuverability of the craft, particularly under circumstances where propelled water craft 1 is steered by foot operation alone, as hereinafter set forth. In a further preferred embodiment, shaft supports 34 are molded integrally with pontoons 2, and port motor 30 and starboard motor 31 are each removably secured in shaft supports 34 by means of a motor shaft 33. Referring now to FIG.

Figure 6:
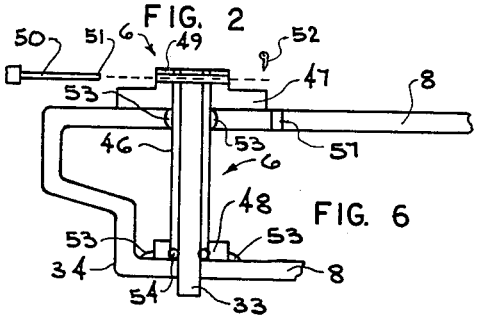
FIG. 6 is an enlarged view of the water craft starboard pontoon section illustrated in FIG. 5, more particularly illustrating a preferred motor mounting configuration.

6, motor shaft 33 is secured inside one of pontoons 2, respectively, by means of a motor shaft retainer assembly 6, provided in shaft supports 34 in order to facilitate access to each motor shaft 33 for maintenance of port motor 30 and starboard motor 31, as illustrated in FIG. 6. Each motor shaft retainer assembly 6 is characterized by a sleeve 46, sealed to and extending from the inside bottom portion of shaft supports 34 through deck 8, and enclosing motor shaft 33 in concentric relationship. A top collar 47 is provided on sleeve 46 at the point of projection of sleeve 46 through deck 8, and a bottom collar 48 serves to secure the bottom end of sleeve 46 tightly against the bottom of each one of shaft supports 34. A collar aperture 49 is provided in the neck of top collar 47 to receive a pin 50, which extends through collar aperture 49 and through registering apertures in sleeve 46 and motor shaft 33 to secure motor shaft 33 inside sleeve 46. A cotter pin 52 can be inserted in pin aperture 51 of pin 50 to secure pin 50 in top collar 47. An O-ring 54 is fitted between motor shaft 33 and the inside of sleeve 46 to prevent water from entering sleeve 46, as illustrated.

Referring now to FIGS. 4, 5 and 6 of the drawing, in a still further preferred embodiment of the invention seat pedestal 20 is fitted with a pedestal flange 21, and is secured to deck 8 by means of flange fasteners 22. Since maximum freedom of the hands is desired while fishing, foot control of the motors is provided by installing a start switch plate 35 on deck 8, which plate is preferably secured to deck 8 by means of plate fasteners 15, as illustrated. A port motor start switch 36 and a starboard motor start switch 37 are provided in close proximity to each other on start plate 35, and are wired to port motor 30 and starboard motor 31, respectively, through the interior of pontoons 2, and through wiring aperture 57 in deck 8, to an electric plug 45, illustrated in FIG. 5. Port motor start switch 36 and starboard motor start switch 37 are characterized as pressure-type switches, and are activated either in unison or separately by foot pressure when the operator is seated in seat 24. Positioned near the top of seat pedestal 20 is a port motor thrust switch 38 and a starboard motor thrust switch 39, which control the forward and reverse thrust of port motor 30 and starboard motor 31, respectively. In close proximity to port motor thrust switch 38 and starboard motor thrust switch 39, are port motor speed control 40 and starboard motor speed control 41, which facilitate power adjustment of port motor 30 and starboard motor 31, respectively. As in the case of port motor start switch 36 and starboard motor start switch 37, the wiring associated with port motor thrust switch 38, starboard motor thrust switch 39, port motor speed control 40 and starboard motor speed control 41, is channelled through pontoons 2 and through electrical plug 45 and motor shaft 33 to port motor 30 and starboard motor 31, respectively.

Figure 9:
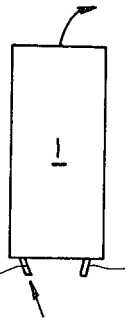
FIG. 9 is a block diagram illustrating a right-hand or starboard turn of the water craft responsive to forward thrust of the port motor only.
Figure 10:
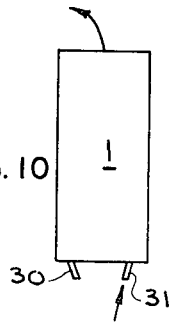
FIG. 10 is a block diagram illustrating a left-hand or port turn of the water craft responsive to thrusting of the starboard motor in the forward direction.

In operation, and referring now to FIGS. 3 and 7–10 of the drawing, when it is desired to operate propelled water craft 1 in the forward direction, port motor thrust switch 38 and starboard motor thrust switch 39 are moved to the "forward" position, and port motor start switch 36 and starboard motor start switch 37 are both depressed by the foot to activate port motor 30 and starboard motor 31, respectively, in the forward direction. Compensation for any difference in the forward speed of port motor 30 and starboard motor 31 is then made, by either manipulating port motor speed control 40 and starboard motor speed control 41, respectively, or by selective activation of the motors, to achieve a uniform forward directional movement of the craft at a desired speed. Similarly, when it is desired to move in the reverse direction from a dead stop in the water, port motor thrust switch 38 and starboard motor thrust switch 39 are both moved rearwardly to achieve reverse thrust in port motor 30 and starboard motor 31, respectively. Port motor start switch 36 and starboard motor start switch 37 may then be simultaneously activated to achieve a rearward directional movement of propelled water craft 1 at a speed determined by manipulation of port motor speed control 40 and starboard motor speed control 41, respectively, or by selective activation of the start switches. When it is desired to make turns in either direction during either forward or reverse movement of propelled water craft 1, such turns can be initiated in three ways. First, and primarily, the turn may be achieved from either a dead stop or during movement of the craft by simply activating the appropriate one of port motor start switch 36 or starboard motor start switch 37, and the thrust of the powered motor, which in a preferred embodiment is mounted in horizontal, angular relationship to the axis of the pontoon in which it is installed, causes movement in the desired direction. Secondly, turning may be effected while running by manipulating the appropriate one of port motor speed control 40 or starboard motor speed control 41, to effect a greater thrust in either port motor 30 or starboard motor 31, as desired. The additional thrust in the selected one of the two motors will effect the desired turn. Referring to FIG. 9, in the first of these two techniques, when port motor 30 is activated by pressing port motor start switch 36 with the foot, the craft moves into a right turn, as illustrated, due to the thrust of propellar 32 and the skewed or angled position of port motor 30. A left-hand turn is initiated as shown in FIG. 10, when starboard motor 31 is activated by pressing starboard motor start switch 37. Alternatively, when it is desired to turn abruptly to the right or starboard, and referring again to FIG. 9 of the drawing, port motor 30 may be caused to thrust in a forward direction at a desired speed by manipulating port motor start switch 36, port motor thrust switch 38, and port motor speed control 40, while starboard motor 31 can be caused to thrust in the reverse direction at a selected speed by manipulating starboard motor start switch 37, starboard motor thrust switch 39, and starboard motor speed control 41. This action will cause propelled water craft 1 to turn to the right or starboard, with an intensity which is dependent upon the relative settings of port motor speed control 40 and starboard motor speed control 41, as heretofore described. Furthermore, when it is desired to turn abruptly to the left or to port, port motor 30 can be caused to thrust in the reverse direction while starboard motor 31 is caused to thrust in the forward direction according to a reverse of the procedure outlined immediately above, as illustrated in FIG. 10.

It will be appreciated by those skilled in the art that the propelled water craft 1 of this invention constitutes a light-weight, highly maneuverable and efficient water craft which is suitable for a variety of purposes, but is particularly well suited for fishing. The motor control system permits great freedom of movement, and freedom of use of the hands in particular, while operating the water craft. Much of the desired movement of the water craft can be achieved by simply pressing port motor start switch 36 and starboard motor start switch 37 by use of the foot without having to use the hands at all. When the other control switches must be manipulated to provide directional control, they can be so activiated by the movement of one hand, and with some practice, by only very slight, momentary movements of the hand. The water craft is a highly stable fishing platform, the stability being provided by the spaced pontoons 2, and it has been found that a relatively large weight placed on one side of the water craft causes very little list of the deck 8. The seat 24 is elevated to a desired height by means of seat pedestal 20, and permits an excellent view of stumps and logs which may be in the general proximity of the water craft to facilitate avoiding becoming lodged on such obstacles. However, in the event the propelled water craft 1 does become lodged on such an obstacle, it is sufficiently light and maneuverable that activation of the motors or a shift in the operator's weight will facilitate removal of the craft from the obstacle. Furthermore, a pair of seats can be provided in the craft as desired, with pontoons 2 and a deck 8 constructed of sufficient size to accommodate the weight of an additional person.

While motors of different design may be utilized in propelled water craft 1, in a preferred embodiment of the invention port motor 30 and starboard motor 31 are electric motors, and are activated by batteries located in battery storage area 43, with the appropriate electrical connections provided according to conventional techniques. Furthermore, port motor 30 and starboard motor 31 can be wired for either 12 or 24 volt operation, or both, as desired. Accordingly, from 1 to 4 batteries may be utilized in propelled water craft 1 to effect the desired propulsion when electric motors are utilized.

As heretofore described, and referring again to FIG. 3 of the drawing, in a preferred embodiment of the invention the front ends of port motor 30 and starboard motor 31 are each horizontally angled to the outside of the longitudinal axis of pontoons 2, respectively. This positioning of the motors in an offset angle range of from about 5 degrees to about 30 degrees, and most preferably, about 15 degrees, has greatly enhanced the maneuverability of propelled watercraft 1, especially under circumstances where it is desired to steer the craft by activation of only one of the motors at a time through foot manipulation of port motor start switch 36 and starboard motor start switch 37. The achievement of such directional control by foot operation alone is highly desirable, particularly when the operator is fishing, because it completely frees the hands during operation of the water craft. While it has been found that the positioning of the front ends of the motor to both the outside and inside of the longitudinal axis of the pontoons aids in directional control, an outside positioning has found to be most efficient in achieving this control.

Having described my invention with the particularity set forth above, what is claimed is:

1. A propelled water craft comprising:

(a) a pair of pontoons in generally parallel, spaced relationship;

(b) a deck connecting and covering said pontoons;

(c) seat means mounted on said deck;

(d) a first reversible electric motor carried by one of said pontoons, and a second reversible electric motor carried by the other of said pontoons, said first reversible electric motor and said second reversible electric motor mounted in fixed relationship on said pontoons, respectively, and the forward ends of said first reversible electric motor and said second reversible electric motor positioned at a pre-selected angle with respect to said pontoons, respectively;

(e) first thrust control means for said first reversible electric motor, and second thrust control means for said second reversible electric motor, mounted on said seat means and cooperating with said first reversible electric motor and said second reversible electric motor, respectively, whereby forward and reverse operation of said first reversible electric motor and said second reversible electric motor are facilitated; and (f) a first motor start switch for said first reversible electric motor, and a second motor start switch for said second reversible electric motor, mounted on said deck and cooperating with said first reversible electric motor and said second reversible electric motor, respectively, whereby said first reversible electric motor and said second reversible electric motor are selectively energized to steer said water craft by operation of one or both of said first reversible electric motor and said second reversible electric motor.

2. The propelled water craft of claim 1 wherein said first and said second reversible electric motor are a variable speed first and second reversible electric motor and said first and second thrust control means further include a first and second speed control switch and a first and second thrust control switch in cooperation with said first reversible electric motor and said second reversible electric motor, respectively.

3. The propelled water craft of claim 1 wherein said seat means further comprises at least one pedestal mounted on said deck and at least one seat rotatably mounted on said pedestal to facilitate 360 degree rotation of said seat with respect to said pedestal and said deck.

4. The propelled water craft of claim 1 wherein:

(a) said first and said second reversible electric motor are a variable speed first and second reversible electric motor and said first and second thrust control means further include a first and second speed control switch and a first and second thrust control switch in cooperation with said first reversible electric motor and said second reversible electric motor, respectively; and (b) said seat means further comprises at least one pedestal mounted on said deck and at least one seat rotatably mounted on said pedestal to facilitate 360 degree rotation of said seat with respect to said pedestal and said deck.

5. The propelled water craft of claim 1 wherein said pre-selected angle is in the range of from about 5 degrees to about 30 degrees outwardly with respect to the longitudinal axis of said pontoons, respectively.

6. The propelled water craft of claim 1 wherein:

(a) said first reversible electric motor and said second reversible electric motor are each reversible, variable speed electric motors and said control means further includes a motor start switch, a speed control switch, and a thrust switch in cooperation with each of said first reversible electric motor and said second reversible electric motor, respectively;

(b) said seat means further comprises a pedestal mounted on said deck and a seat rotatably mounted on said pedestal to facilitate 360 degree rotation of said seat with respect to said pedestal and said deck; and (c) said pre-selected angle is in the range of from about 5 degrees to about 30 degrees outwardly with respect to the longitudinal axis of said pontoons, respectively.

7. A propelled water craft comprising:

(a) a pair of spaced, generally parallel pontoons having an upward turned frontal portion;

(b) a generally flat deck connecting and covering said pontoons;

(c) at least one hollow seat pedestal mounted on said deck;

(d) at least one folding seat rotatably mounted on said seat pedestal to facilitate 360 degree rotation of said seat with respect to said seat pedestal;

(e) a first battery-powered, reversible, variable speed electric motor mounted in fixed relationship on the rear of one of said pontoons, and having the forward end of said first battery-powered, reversible, variable speed electric motor positioned at an angle of from about 5 degrees to about 30 degrees outwardly with respect to the longitudinal axis of said one of said pontoons, and a second battery-powered, reversible, variable speed electric motor mounted in fixed relationship on other of said pontoons, and having the forward end of said second battery-powered, reversible, variable speed electric motor positioned at an angle of from about 5 degrees to about 30 degrees outwardly with respect to the longitudinal axis of said other of said pontoons, respectively;

(f) a pair of motor start switches cooperating with said first battery-powered, reversible, variable speed electric motor, and said second battery-powered, reversible, variable speed electric motor, respectively, and located on said deck at the foot of said pedestal and in close proximity to the feet of an operator when said operator is seated in said seat;

(g) a pair of motor thrust switches cooperating with said first battery-powered, reversible, variable speed electric motor and said second battery-powered, reversible, variable speed electric motor, respectively, and located on one side of said pedestal; and (h) a pair of motor speed control switches cooperating with said first battery-powered, reversible, variable speed electric motor, and said second battery-powered, reversible, variable speed electric motor, respectively, and located on said one side of said pedestal adjacent said motor thrust switches.

8. The propelled water craft of claim 7 wherein said pre-selected angle is about 15 degrees with respect to the longitudinal axis of said pontoons.

9. The propelled water craft of claim 7 further comprising an insulated ice chest and an insulated live well provided in said deck and said pontoons and positioned on each side of said seat pedestal.

10. The propelled water craft of claim 7 further comprising a deck rail extending from near the front of said deck continuously around the sides and rear of said deck and secured to said deck, and motor shaft retainer assembly means cooperating with said first motor and said second motor and said pontoons to removably secure first motor and said second motor in said pontoons, respectively, and access caps removably secured to said deck to facilitate maintenance of said first motor and said second motor.

11. The propelled water craft of claim 7 wherein said pre-selected angle is about 15 degrees with respect to the longitudinal axis of said pontoons and further comprising:

(a) an insulated ice chest provided on one side of said seat pedestal and an insulated live well provided on the other side of said seat pedestal, said ice chest and said live well being enclosed in said deck and said pontoons and dividing each of said pontoons into three watertight compartments; and (b) a deck rail extending from near the front of said deck continuously around the sides and rear of said deck and secured to said deck.

12. The propelled water craft of claim 7 wherein said motors are wired to operate on both 12 volts and 24 volts.

13. The propelled water craft of claim 7 wherein said pre-selected angle is about 15 degrees with respect to the longitudinal axis of said pontoons said first battery-powered, reversible, variable speed electric motor and said second battery-powered, reversible speed electric motor being selectively wired to operate on both 12 volts and 24 volts, respectively, and further comprising:

(a) an insulated ice chest and an insulated live well provided in said deck and said pontoons and positioned on each side of said seat pedestal and dividing each of said pontoons into three watertight compartments; and (b) a deck rail extending from near the front of said deck continuously around the side and rear of said deck and secured to said deck.

* * * * *